US006729706B1

(12) United States Patent
Patton et al.

(10) Patent No.: US 6,729,706 B1
(45) Date of Patent: May 4, 2004

(54) LARGE AREA MARKING DEVICE AND METHOD FOR PRINTING

(75) Inventors: David L. Patton, Webster, NY (US); Loretta E. Allen, Hilton, NY (US); Steven S. Chapman, Corfu, NY (US); Dale F. McIntyre, Honeoye Falls, NY (US); Jacob L. Pietruszewski, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/366,933

(22) Filed: Feb. 14, 2003

(51) Int. Cl.[7] ..... B41J 3/00; B41J 25/308; B41J 23/00

(52) U.S. Cl. ..... 347/2; 347/8; 347/37

(58) Field of Search ..... 347/2, 8, 37

(56) References Cited

U.S. PATENT DOCUMENTS

| | | | | |
|---|---|---|---|---|
| 3,858,359 A | | 1/1975 | Leliaert | 451/88 |
| 4,748,453 A | | 5/1988 | Lin et al. | |
| 5,186,983 A | | 2/1993 | Brown | |
| 5,446,559 A | | 8/1995 | Birk | |
| 5,893,678 A | | 4/1999 | Laybros et al. | |
| 5,925,889 A | * | 7/1999 | Guillory et al. | 250/559.16 |
| 5,927,872 A | | 7/1999 | Yamada | |
| 5,931,166 A | * | 8/1999 | Weber et al. | 132/73 |
| 6,062,686 A | | 5/2000 | Kinoshita et al. | |
| 6,074,693 A | | 6/2000 | Manning | |
| 6,116,707 A | | 9/2000 | Avida | |
| 6,173,904 B1 | | 1/2001 | Doherty et al. | |
| 6,227,643 B1 | | 5/2001 | Purcell et al. | |
| 6,241,410 B1 | | 6/2001 | Hager | |
| 6,295,737 B2 | | 10/2001 | Patton et al. | 33/18.1 |
| 6,299,934 B1 | | 10/2001 | Manning | |
| 6,561,607 B1 | * | 5/2003 | Lubinsky et al. | 347/8 |

FOREIGN PATENT DOCUMENTS

EP 0 544 487 B1 7/1996

* cited by examiner

*Primary Examiner*—Stephen D. Meier
*Assistant Examiner*—Alfred Dudding
(74) *Attorney, Agent, or Firm*—Norman Rushefsky

(57) ABSTRACT

A method and apparatus for printing an image on a large surface area or walkway provides for imagewise marking of the surface with a color marking solution, to form a visible image on the surface during an image recording mode of a marking engine. A vehicle supports the marking engine and includes a drive that engages the surface at plural locations and moves the marking engine relative to the surface. The marking engine is located outboard of an area defined by lines connecting the plural locations so that during operation of the marking engine during the image recording mode the drive does not engage areas of the surface that have been previously imagewise marked.

30 Claims, 15 Drawing Sheets

LARGE AREA MARKING DEVICE AND METHOD FOR PRINTING

CROSS REFERENCE TO RELATED APPLICATIONS

This application is related to U.S. application Ser. No. 10/346,148, filed Jan. 16, 2003, in the names of David L. Patton et al and entitled, "Printing and Apparatus For Printing An Image on a Selected Surface."

FIELD OF THE INVENTION

This invention is directed to printing apparatus and method for forming an image over a large surface area or walkway such as driveways, fields and/or decks or patios.

BACKGROUND OF THE INVENTION

This invention generally relates to a marking apparatus and methods and more particularly relates to an apparatus and method for marking a large surface with multiple colors.

It is often desirable to form color images on a large area. For example, children love to draw and write with colored chalk on a driveway. Similarly to drawing with a crayon on a blank piece of paper the child creates drawings, but does not usually have the ability to draw detailed animals, cartoon characters, scenes, and the like. Children like to color in coloring books and print images using a desktop inkjet printer because they can create detailed drawings that are in full color. These activities are fun, and the child does not need the skills of an artist to produce colorful graphic images. When the child attempts to draw the image manually on a surface such as a driveway, the result may be less than satisfactory. Therefore, it is desirable to provide a marking device capable of forming more pleasing images on a large surface such as a driveway.

U.S. Pat. Nos. 5,446,559 and 6,062,686 disclose devices that are designed to print on a small smooth surface such as a sheet of paper on a table or desktop. Because of their compact construction, these so-called handheld devices are not burdened by the size and weight of conventional devices that perform similar functions, such as desktop and large format printers. Furthermore, these handheld devices offer superior flexibility in printing and can be used with over sized media. For example, such handheld devices can print on media that is much larger than used in a desktop printer.

Despite such positive attributes of these handheld devices such as being compact, other less desirable attributes still remain. For example, these handheld devices still require the attention and labor of the user to manually sweep them over an appropriate medium to produce printing on the medium. They are limited in size to a medium that is the size of a sheet of paper or a poster. They are not equipped to print on a rough surface such as asphalt or concrete. To overcome the problems of conveying a hand held device over the surface to be printed a drive mechanism was added. Unlike a desktop printer, the drive mechanism contacts the surface being printed. This creates the problem of contacting the area that has just be printed and damaging the image. In small format printers and printers that are printing several lines of text this is not a problem, but it is a problem for a device printing a large area with a continuous image.

Charles Manning in U.S. Pat. Nos. 6,299,934 and 6,074,693 discloses a global positioning system for controlling a paint spraying system used to apply paint to a large surface such as a road. The systems described in these patents may be suited for locating a paint sprayer used for painting lines on a road to within a few feet, but GPS systems do not possess the positioning precision required for printing an image. Moreover, the paint-spraying device described by Manning does not have the ability to deliver a marking medium to the marking surface with the amount and with the accuracy necessary to form a desirable image.

Therefore, there has been a long-felt need to provide an apparatus and method for suitably marking a large area in a manner which automatically accurately determines the size of the large area to be printed, the distance to the surface and quickly, yet precisely, applies a marking medium uniformly to predetermined portions of the surface and can provide multiple color marking to the surface wherein the surface comprises large surface areas of pavement, wood or other structural composites, or concrete, asphalt, brick, grass or laid carpeting collectively hereinafter referred to as a "walkway," even though cars or other vehicles may also be driven over same.

SUMMARY OF THE INVENTION

A method and apparatus for conveying a portable printing mechanism over a large surface area such as a walkway having a printing means for forming indicia on the surface area is described.

In accordance with a first aspect of the invention, there is provided an apparatus for printing an image on a large surface area or walkway, the apparatus comprising a marking engine responsive to digital signals representing an image for imagewise marking the surface with a color marking solution; i.e. dye or pigment of ink or paint that is in solution or suspension in a liquid, to form a visible image on the surface during an image recording mode; a self-propelled and automatically steered vehicle that supports the marking engine and includes a drive that engages the surface at plural locations for moving the marking engine along the surface. It is preferred to provide the marking engine so that it is located outboard of an area defined by lines connecting the plural locations so that during operation of the marking engine for imagewise marking during the image recording mode the drive does not engage areas of the surface that have been previously imagewise marked and the drive providing movement of the marking engine to position the marking engine at substantially all points to be marked in the area.

In accordance with a second aspect of the invention, there is provided a method for printing an image on a large surface area or walkway, the method comprising imagewise marking the surface with a color marking solution to form a visible image on the surface during an image recording mode of a marking engine that is responsive to digital image signals representing the visible image to be printed; automatically steering a vehicle that supports the marking engine and which includes a drive that engages the surface at plural locations and moving the marking engine relative to the surface, the marking engine being located outboard of an area defined by lines connecting the plural locations so that during operation of the marking engine for imagewise marking during the image recording mode the drive does not engage areas of the surface that have been previously imagewise marked and the drive providing movement of the marking engine to position the marking engine at substantially all points to be marked in the area.

In the preferred embodiment the invention comprises a printing assembly including a housing, a drive and steering mechanism, a power supply, a printer, logic and control unit, and a communications device. The portable printing mechanism can be electronically guided by a removable Erasable Programmable Read Only Memory (EPROM) located in the logic and control unit or it can be guided by transmissions from a remote control device. Alternately, the portable printing mechanism can optically follow a line manually drawn on the driveway or other large surface area.

The portable printing mechanism maps the area to be printed, determines where within the area the indicia is to be formed and the initial starting position, maintains the correct distance between the print head and the surface area to be printed, and maintains the correct spacing of the lines being printed while the indicia is formed.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENTS

The invention will be described in detail with particular reference to certain preferred embodiments thereof, but it will be understood that variations and modifications can be effected within the spirit and scope of the invention.

Figure 1:
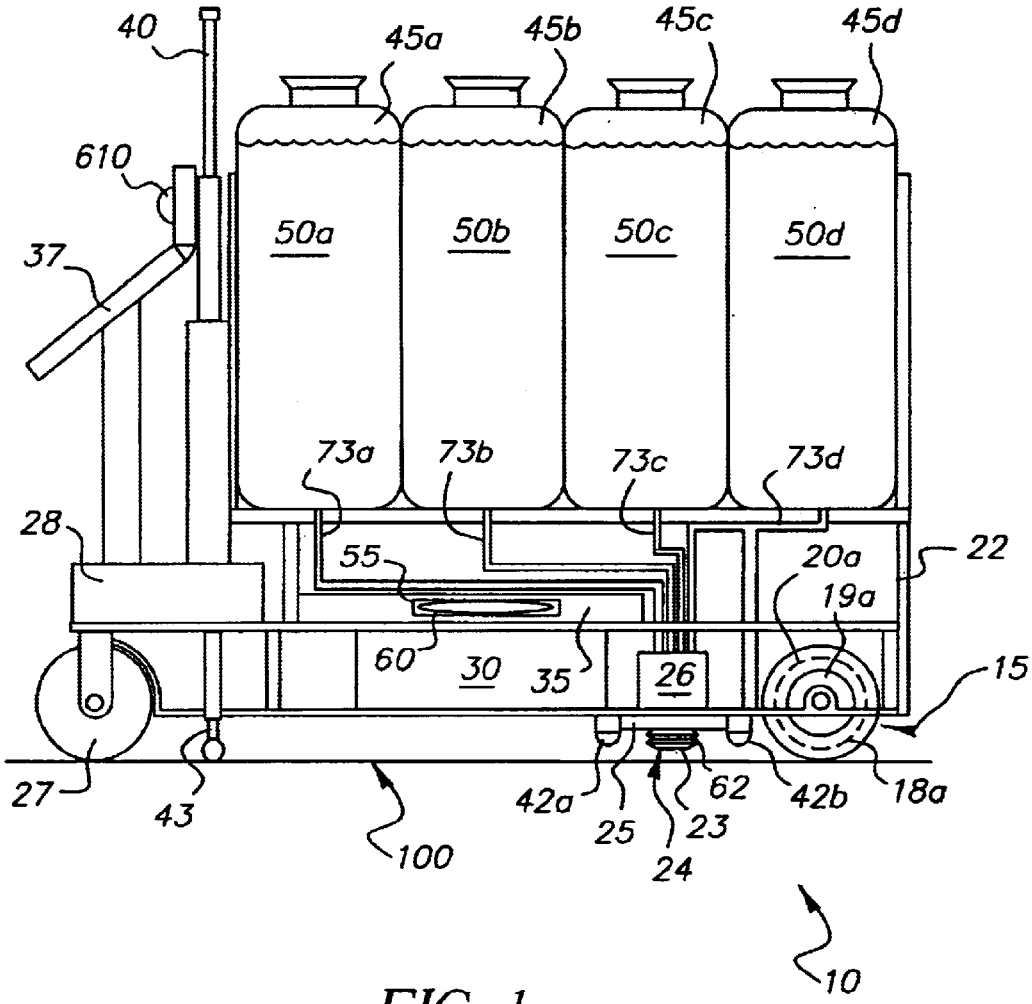
FIG. 1 is a view in elevation of one embodiment of the present invention showing an apparatus for printing on a large surface area made in accordance with the present invention.
Figure 2:
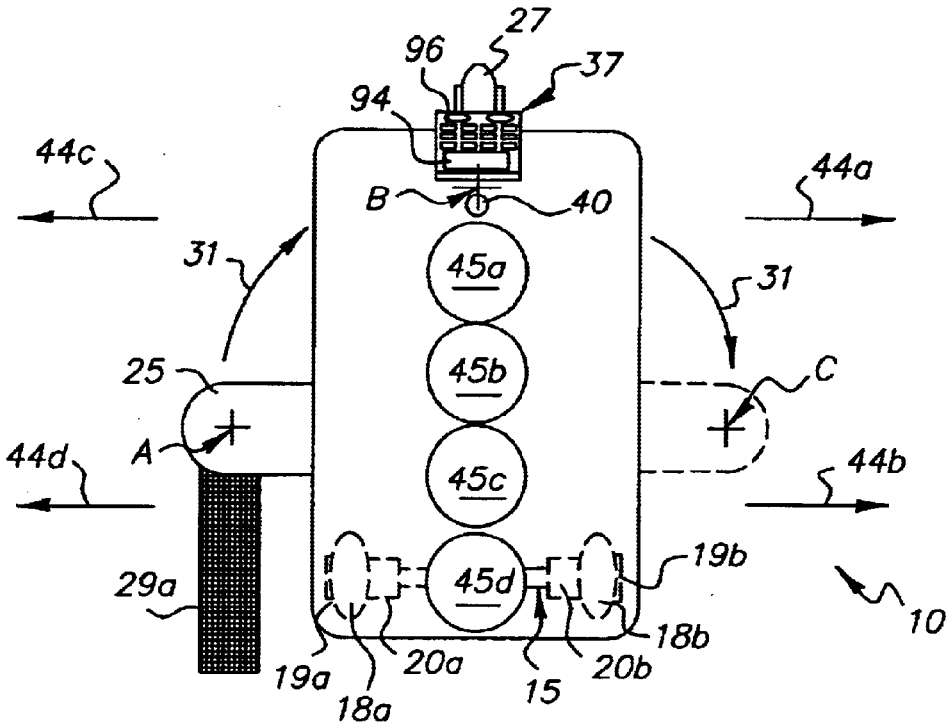
FIGS. 2 and 3 are top plan views of the apparatus of FIG. 1.
Figure 3:
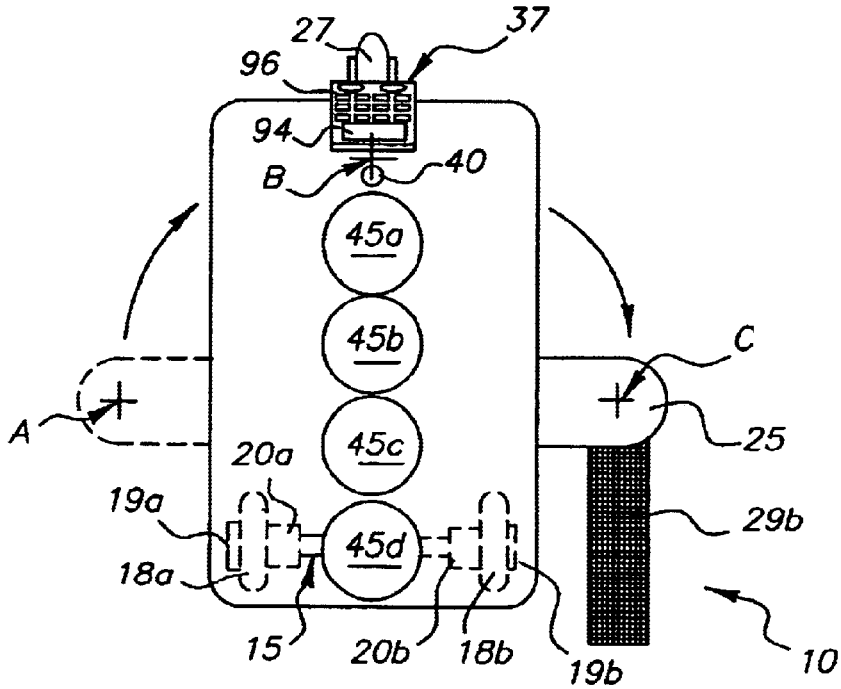
Figure 9:
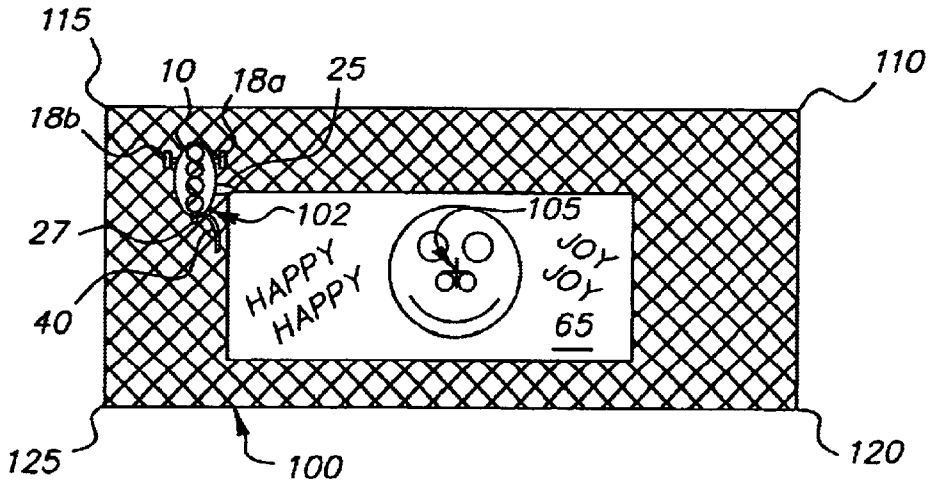
FIG. 9 is a schematic drawing on a large surface area or walkway with an image formed thereon by the apparatus illustrated in FIG. 1.

Referring to FIGS. 1, 2 and 3 apparatus 10 is a device for printing on a large surface area or walkway 100 such as a driveway and other large surface areas suited for walking upon or driving a vehicle upon as referred to above (See FIG. 9). Apparatus 10 is a wheeled vehicle that includes a propulsion assembly 15 including a set of two drive wheels 18*a* and 18*b* each with an encoder 19*a* and 19*b*, and stepper motors 20*a* and 20*b* mounted on a frame 22. Apparatus 10 also comprises a marking engine 23 with a thermo-mechanically activated DOD (Drop on Demand) print head 24, which may be a piezoelectric inkjet print head of the type disclosed in commonly assigned U.S. Pat. No. 6,295,737. Other types of inkjet print heads may also be used including thermally actuated inkjet print heads and continuous inkjet print heads.

Marking engine 23 is mounted on a sliding or rotating arm 25 having an arm positioner 26. Apparatus 10 further comprises a steerable wheel 27, a steering control 28, a power supply 30, a logic and control unit 35, a communications device 40, sensors 42*a* and 42*b*, guide finger 43 and reservoirs 45*a*, 45*b*, 45*c* and 45*d*. In this embodiment four reservoirs are shown however there may be more or fewer reservoirs. Reservoirs 45*a*, 45*b*, 45*c* and 45*d* contain marking solutions 50*a*, 50*b*, 50*c*, and 50*d* for example, cyan, magenta, yellow and white marking solutions, respectively. In the present invention, marking solutions can be inks, dyes, paint, or pigments etc., and can form a permanent or temporary visible image. It is understood that any color or combination of colors may be used to form an image as required. Additional reservoirs and print stations may be provided for printing spot colors particularly suited for coloration of logos.

The apparatus 10 is controlled by logic and control unit 35 that includes a microprocessor and which receives instructions from various sources such as from an input panel 37, from an internal memory source (not shown), from the communication device 40, from the sensors 42*a* and 42*b*, from guide finger 43 or from an Erasable Programmable Read Only Memory (EPROM) 55, which can be inserted into the Erasable Programmable Read Only Memory (EPROM) slot 60. Other types of memory such as floppy disks, CD, CD-R, DVD, Picture Disc, memory sticks, tape, etc. may be used. The logic and control unit 35 uses instructions from the aforementioned sources to control the marking engine 23, the propulsion assembly 15, the steering control 28, the rotating arm 25 and arm positioner 26 to form an image 65 on large surface area or walkway 100 as shown in FIG. 9. The logic and control unit 35 is connected to marking engine 23, the rotating arm 25 and arm positioner 26, sensors 42*a* and/or 42*b* and positioning mechanism 62 for controlling the position of marking engine 23 in relationship to the area 100. The rotating arm 25 allows the marking engine 23 supported on the rotating arm 25 to be positioned outboard of the apparatus 10 such that when a swath 29*a* or 29*b* is printed the wheels 18 do not run over the swath 29*a* or 29*b*. As used herein the term "outboard" implies support of the print head for printing on the walkway at locations outside of the enclosed area defined by the current points of contact of the wheels (such as for example 18*a*, 18*b* and 27) which support the apparatus on the walkway. The wheels 18*a*, 18*b* and 27 may be relatively positioned on the vehicle so that they engage the surface as a tricycle would with three points of contact. The arm 25 may be rotated as indicated by the arrows 31 to positions "A", "B", or "C" depending on what is being printed. In this regard rotation of the arm 25 may be provided by a stepper motor or other mechanism attached to the arm for swinging it outboard from a storage position. In an alternative embodiment, the arm may be locked in the outboard position.

The apparatus 10 may move laterally to the right in the direction indicated by arrows 44*a* and 44*b* or to the left in the direction indicated by arrows 44*c* and 44*d* by auxiliary wheels not shown. Sensors 42*a* and/or 42*b* are disposed in sensing relationship to area 100 for sensing the vertical distance to area 100. Sensors 42*a* and/or 42*b* sense the distance to area 100, and send a signal via logic and control unit 35 to the positioning mechanism 62. The positioning mechanism 62 moves the marking engine 23 and thus print head 24 as indicated by arrow 66 (FIG. 4) maintaining constant distance between print head 24 and walkway area 100 to allow the respective multi-color ink or paint marking mediums 50*a*, 50*b*, 50*c*, and 50*d* to be applied to area 100 in accordance with the image to be formed. When apparatus 10 is in an image recording mode, printing is carried out by activating the logic and control unit 35 which in turn activates the stepper motors 20*a* and 20*b* to propel the apparatus 10 over the large surface area 100. In response to the position encoder means associated with each of the drive wheels 18*a* and 18*b*, and a print signal received by the apparatus 10, the marking engine 23 is selectively activated by the logic and control unit 35 to print the sequential printing swaths 29*a* or 29*b*.

In the preferred-embodiment of the present invention, there is adopted a printing method wherein the printing operation is divided into printing a plurality of printing swaths 29*a* or 29*b* upon the large surface area 100. The plurality of printing swaths 29*a* or 29*b* are adjacent to one another and are printed in sequential order as the apparatus 10 is guided over the surface area 100. The printing may also be accomplished by printing a raster line rather than a swath, which comprises a plurality of raster lines. The printing is carried out by activating the stepper motors 20*a* and 20*b* to propel the apparatus 10 over the surface area 100. In response to the encoders 19*a* and 19*b*, sensors 42*a* and 42*b*, and a print signal received by the apparatus 10, the print head 24 is selectively activated by the logic and control unit 35 to print the sequential printing swaths 29*a* or 29*b*. In addition, to prevent apparatus 10 from rolling over a swath already printed, the apparatus 10 is controlled in accordance with programming in the logic and control unit to laterally translate to the right in the direction indicated by arrows 44*a* and 44*b* or to the left in the direction indicated by arrows 44*c* and 44*d* by auxiliary wheels not shown, pivot around the common point 72 using the drive propulsion mechanism 15 and steering control 28 and/or move the print head 24 via the arm positioner 26 moving the arm 25 outboard of the apparatus 10 as shown in FIGS. 2 and 3. In printing of a swath multiple passes may also be provided so as to avoid printing adjacent pixels simultaneously.

Figure 4:
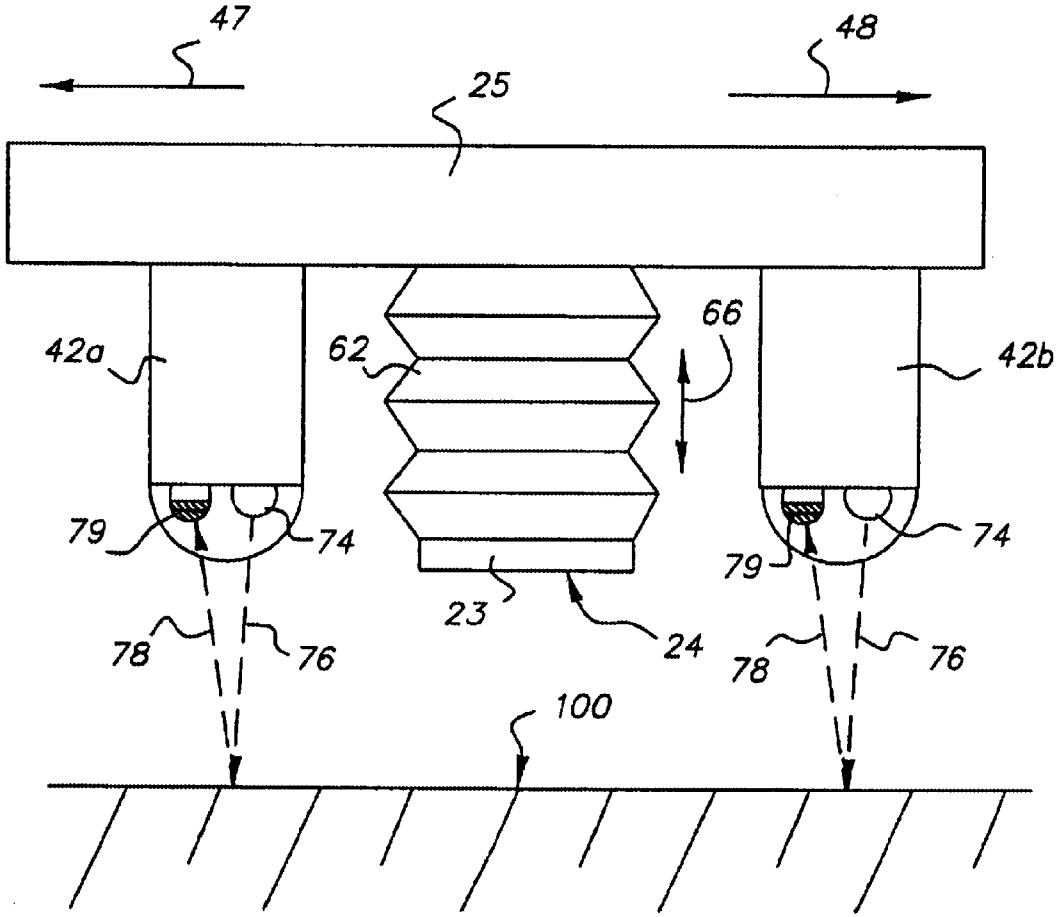
FIG. 4 is a view in elevation of a portion of the apparatus of FIG. 1 and showing one embodiment of the present invention showing a sensor comprising a laser system for measuring distance to a surface from the print head.

Referring to FIG. 4, sensor 42*a* and/or 42*b* is preferably a laser system comprising a photodiode light source 74 capable of emitting a laser light beam 76 to be intercepted by area 100 and reflected therefrom to define a reflected light beam 78. In such a laser system, sensors 42*a* and/or 42*b* further comprises a light detector 79, which may be a CCD (charged Couple Device) associated with light source 74 for detecting reflected light beam 78. In this regard, the laser system comprising light source 74 and detector 79 may be a modified "IMPULSE"™ model laser system available from Laser Technology, Incorporated located in Englewood, Colo. In addition to sensing the distance from the print head 24 to the area 100 sensors 42*a* and/or 42*b* may be used to determine the relative color of the area to be printed for example white concrete or black asphalt. The mechanism for adjusting the position of the print head relative to the walkway surface area 100 may be a bellows type mechanism or telescoping-like or piston-like mechanism.

Figure 5:
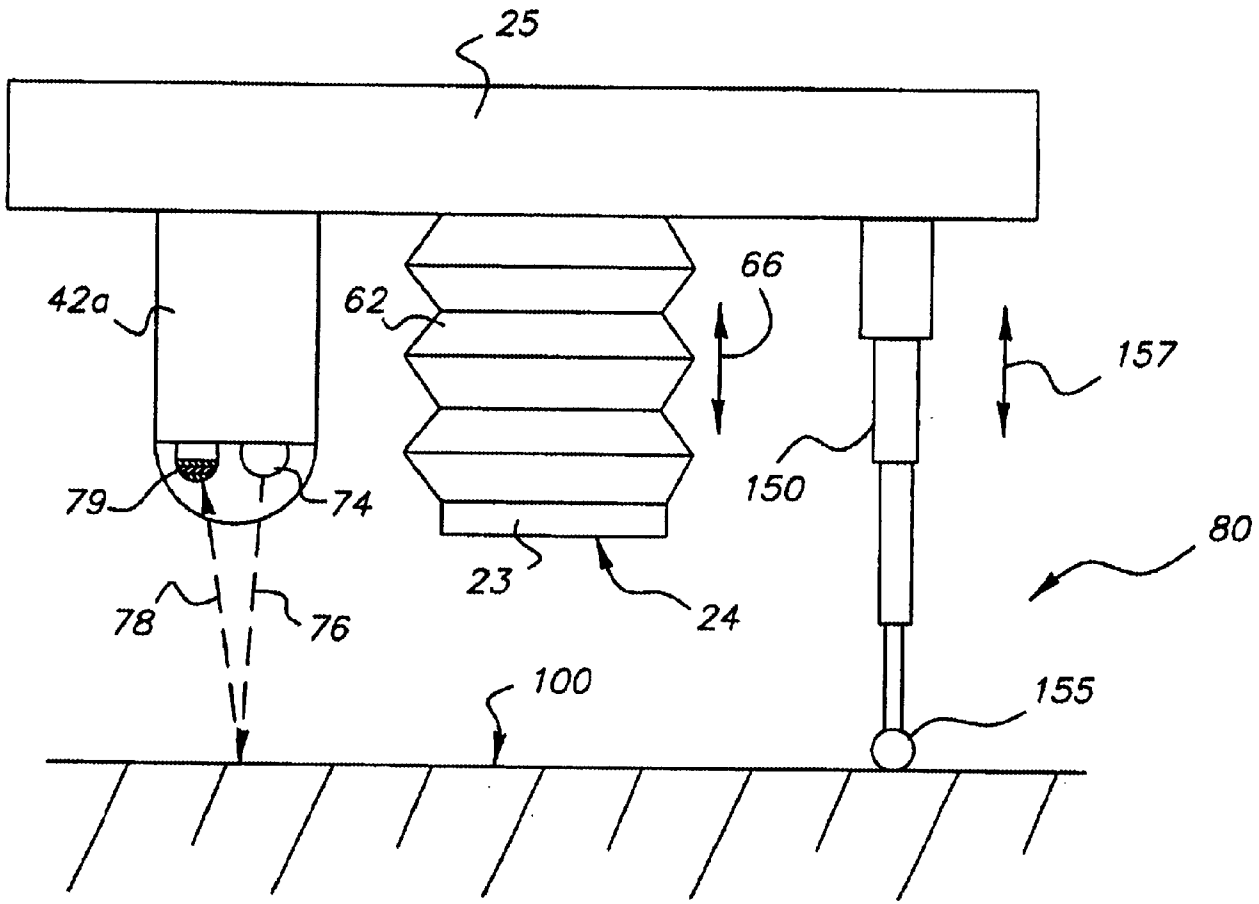
FIG. 5 is a view in elevation similar to that of FIG. 4 but illustrating another embodiment of the present invention showing a sensor comprising a mechanical follower for measuring distance to the surface from the print head for use in the apparatus of the invention.

Referring to FIG. 5, as another embodiment of the present invention, sensor 80 is a mechanical follower mechanism comprising a telescoping spring-loaded follower 150 having an end portion 155 (e.g., a rollable ball bearing) adapted to contact area 100 and follow there along. In this case, telescoping follower 150 is capable of extending and retracting as indicated by arrow 157 in order to follow contour of area 100, and is also capable of generating an electrical signal indicative of the amount follower 150 extends and retracts with respect to area 100. It should be appreciated that sensor 80 and print head 24 need not be pointing at the same location on area 100 as long as the initial position of sensor 80 relative to the initial position of print head 24 is known at the start of the mapping process.

Figure 6:
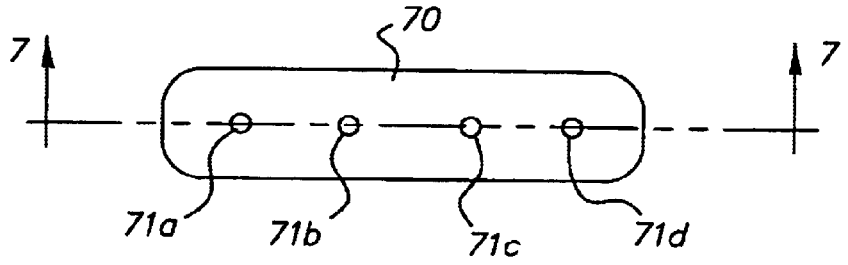
FIG. 6 is a fragmentary view showing a multiple color print head forming a part of the apparatus of FIG. 1.
Figure 7:
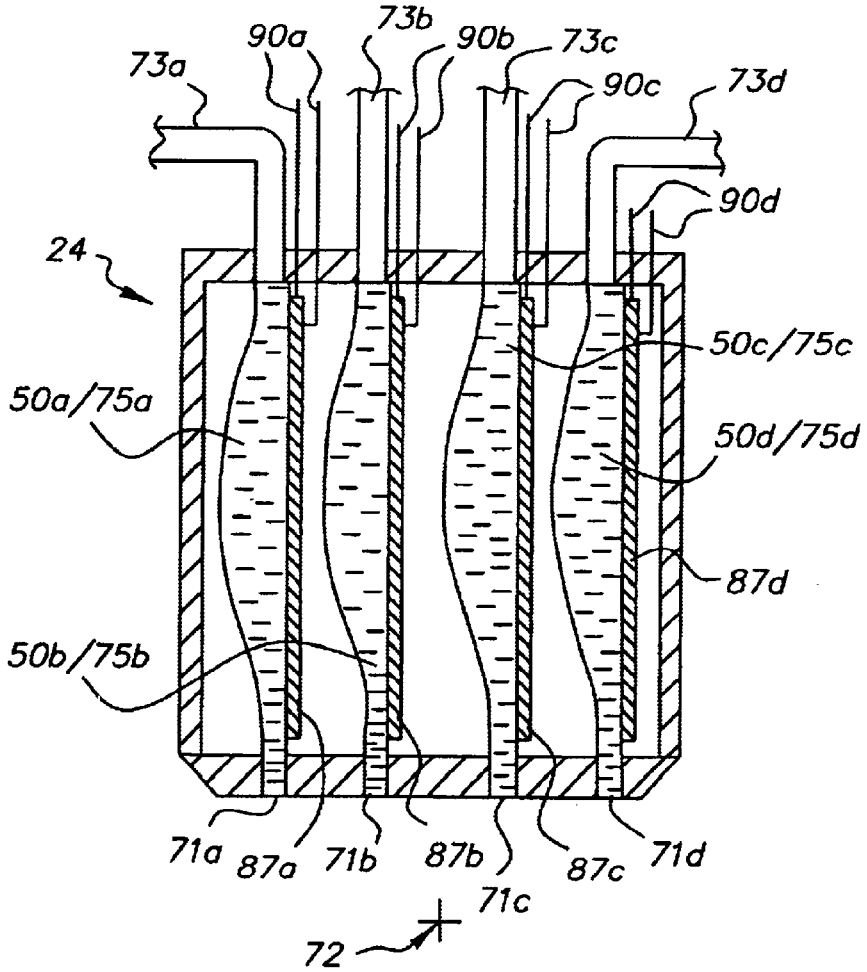
FIG. 7 is a cross-sectional view of the multiple color print head of FIG. 6 as taken along line 7—7 of FIG. 6.

Referring now to FIG. 6, print head 24 (see FIG. 1), which in this embodiment is a DOD inkjet print head comprises a plate 70 having a plurality of nozzles 71*a*, 71*b*, 71*c*, and 71*d*. As previously discussed in FIG. 1 like numerals indicate like parts and operations. Each of the nozzles is capable of ejecting a drop 88 (see FIG. 8) of marking solution 50*a* therefrom to be intercepted by the large surface area 100. Referring to FIG. 7, there is illustrated a cross-sectional view of the print head 24 as taken along line 7—7 of FIG. 5. Nozzles 71*a*, 71*b*, 71*c*, and 71*d* are connected to channel-shaped chambers 75*a*, 75*b*, 75*c* and 75*d*. The chambers 75*a*, 75*b*, 75*c* and 75*d* are in liquid flow communication with respective reservoirs 45*a*, 45*b*, 45*c* and 45*d* shown in FIG. 1 via flexing tubing lines 73*a*, 73*b*, 73*c*, and 73*d* respectively. In this manner, respective color marking solutions of color ink or paint flow through respective tubing lines 73*a*, 73*b*, 73*c*, and 73*d* and into respective chambers 75*a*, 75*b*, 75*c* and 75*d*. In addition, each of the nozzles 71*a*, 71*b*, 71*c*, and 71*b* defines a nozzle orifice 81*a*, 81*b*, 81*c*, and 81*d* communicating with chamber 75*a*, 75*b*, 75*c* and 75*d* respectively for flow of the respective liquid to the respective nozzle orifice.

Figure 8:
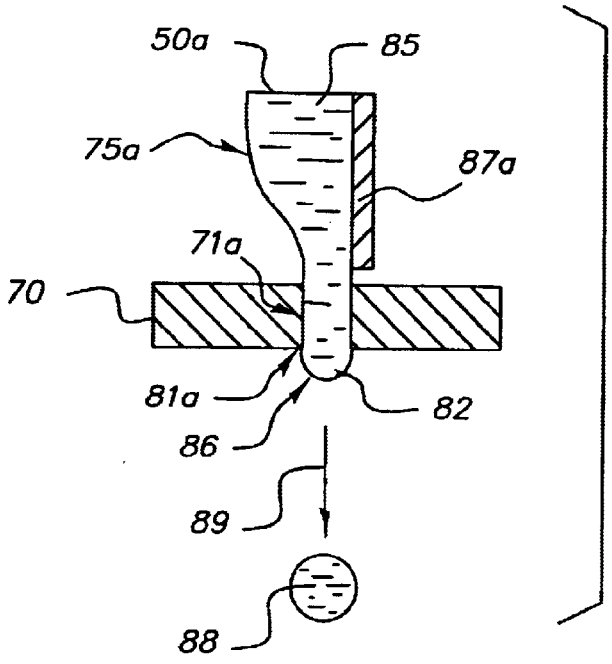
FIG. 8 is an enlarged view of a nozzle of the print head of FIGS. 6 and 7.

Referring now to FIG. 8, which is an enlargement of the nozzle 71*a* of FIG. 7. As the marking solution flows into chamber 75*a* a marking solution body 85 is formed. A marking solution meniscus 82 is disposed at orifice 81*a* when marking solution body 85 is disposed in chamber 75*a*. In this position of marking solution meniscus 82, marking solution meniscus 82 has a surface area 86. By way of example only and not by way of limitation, orifice 81*a* may have a radius of approximately 60 $\mu$m. When a voltage is applied to piezoelectric transducer 87*a*, drop 88 of marking solution 50*a* is ejected from nozzle 71*a* in the direction of arrow 89.

Figure 11:
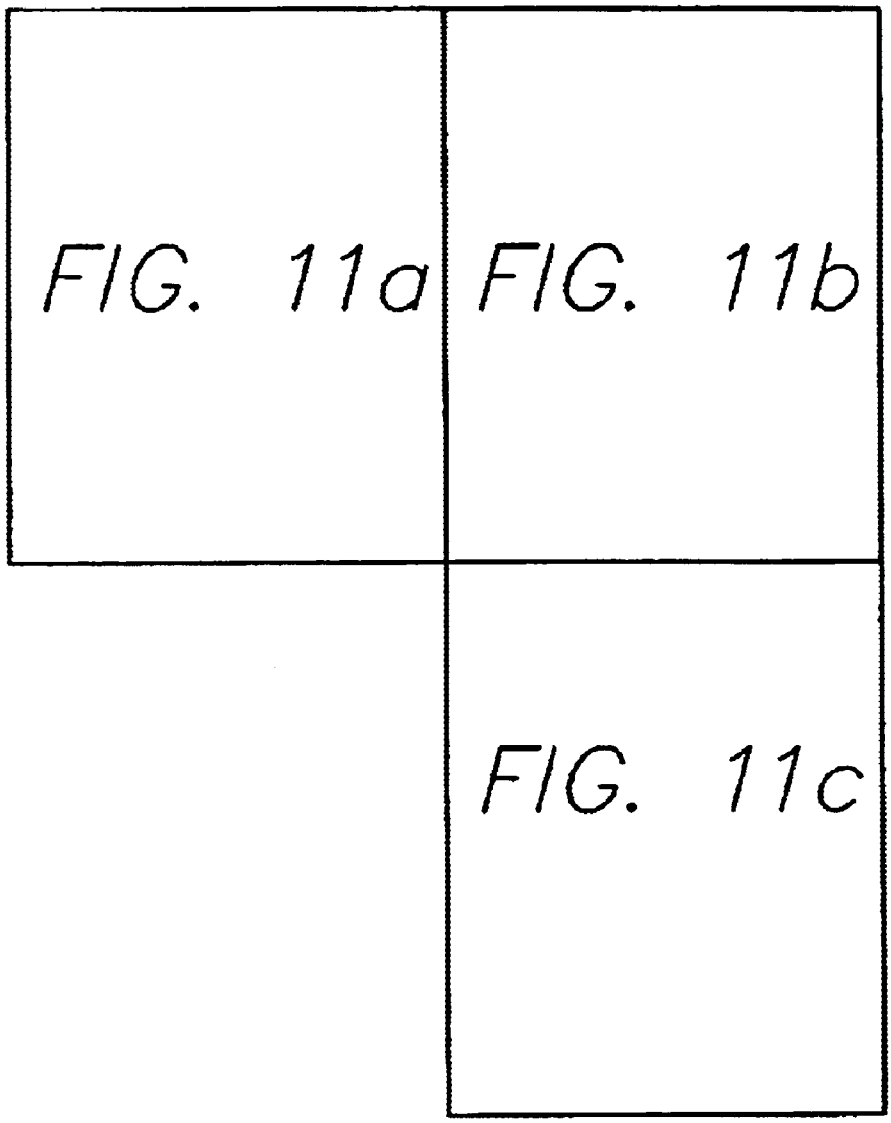
FIGS. 11, 11*a*, 11*b* and 11*c* are a logic flowchart of a process for mapping an image onto a large surface area or walkway in accordance with the invention.
Figure 11A:
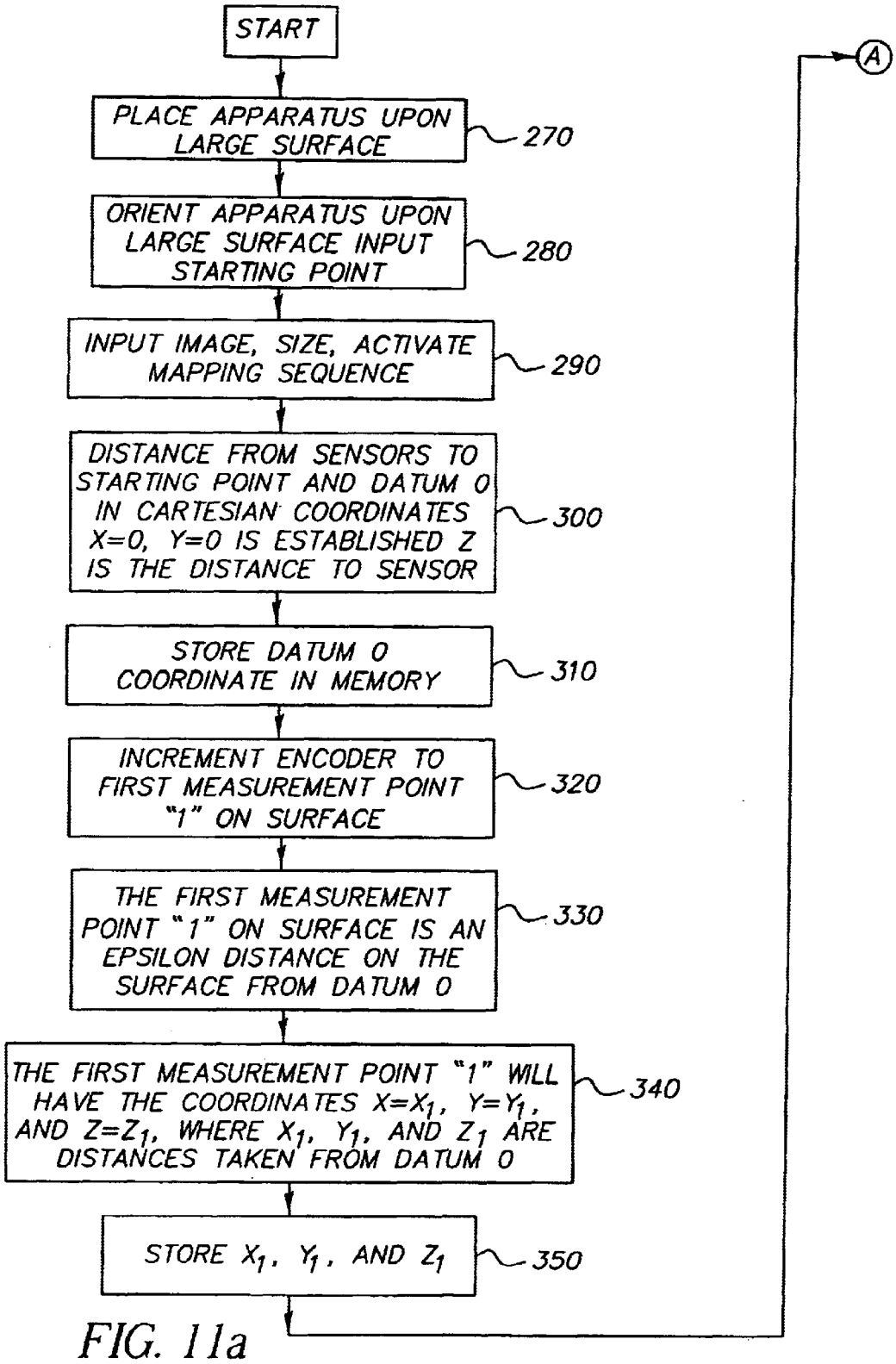
Figure 11B:
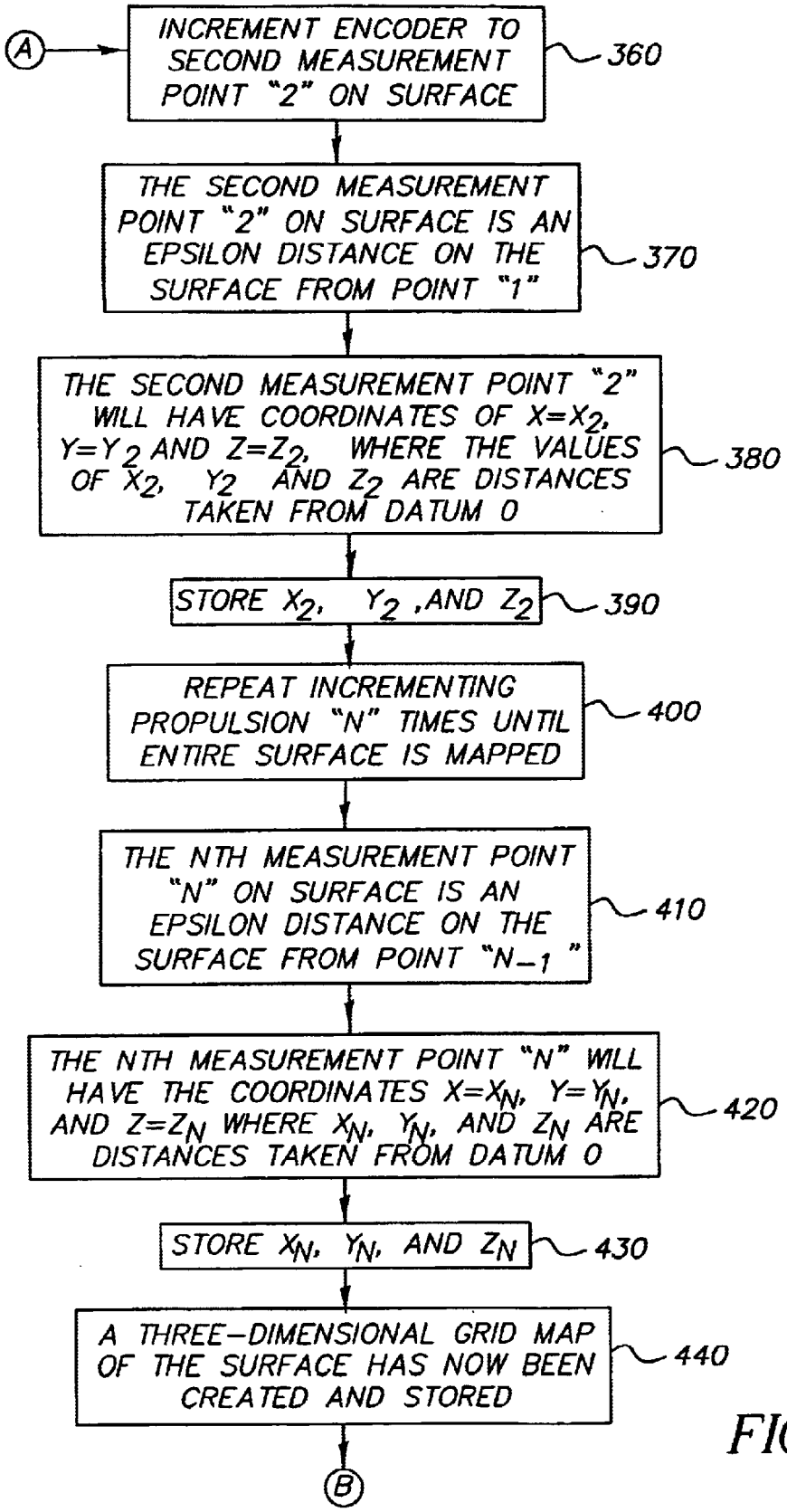
Figure 11C:
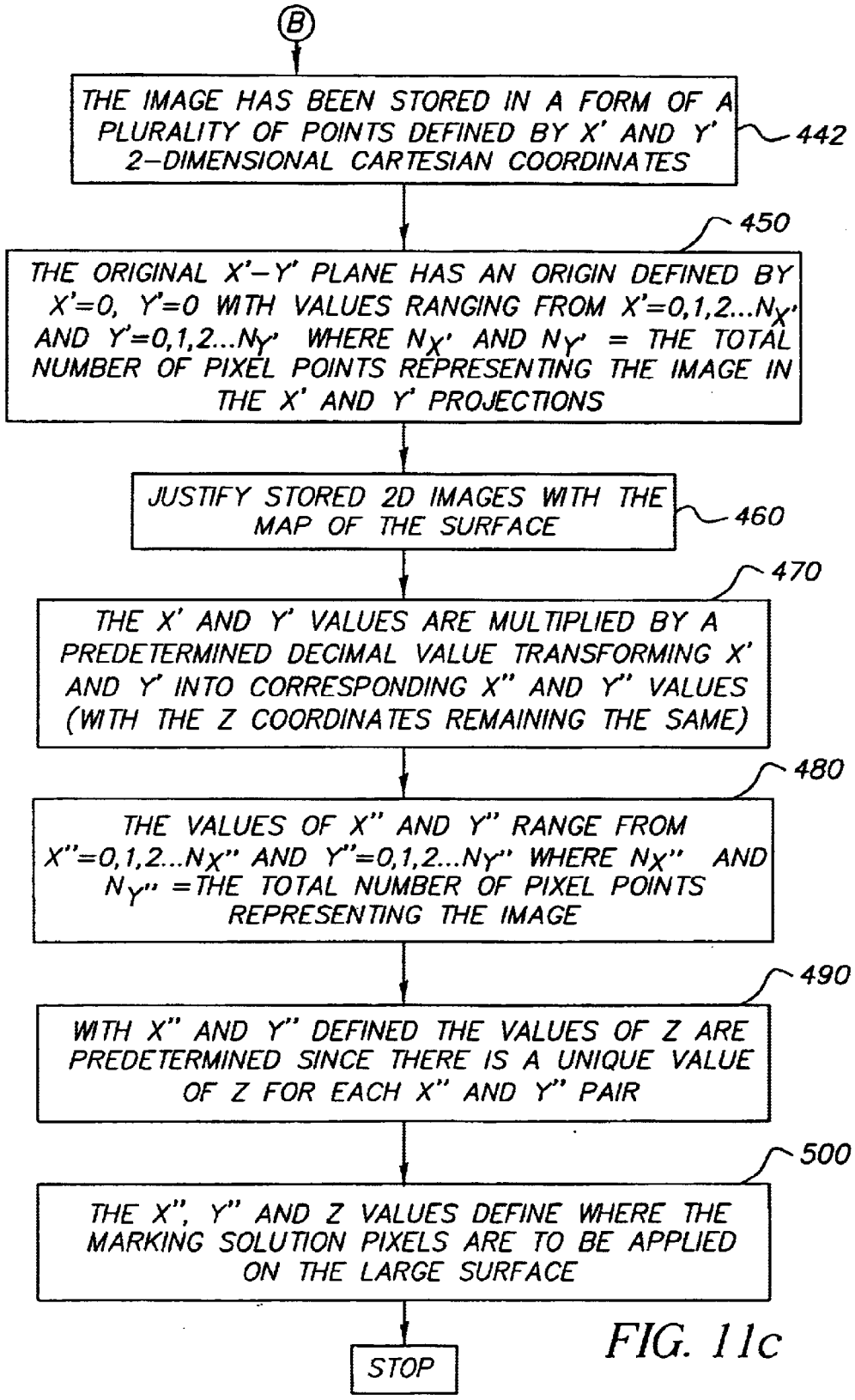

Referring again to FIG. 7, the plurality of nozzles 71*a*, 71*b*, 71*c*, and 71*d* are pointed at the common point 72 so that varying colors can be created with a single pass of the print head 23. The marking engine 23 may comprise more than one print head 24. The controls for the multihead print head can also be programmed to provide for color marking of adjacent spots or spots somewhat spaced from each other. The amount of marking solution 50*a*, 50*b*, 50*c*, and 50*d* amount may range in drop size from 32 Pico liters to 300 Pico liters depending on the amount of coverage, resolution in dots per inch and the time to print desired. For example, using a drop size of 128 Pico liters and a resolution of 150 pixels per inch a six foot by six foot image may be printed in approximately four and one half minutes or at a print rate of approximately 500 square feet per hour. The amount of coverage also depends of the characteristics of the surface being covered. The coarser the surface the greater the coverage required. The multiple colors for a pixel may not exactly overlap but can have some overlap or else a close positioning relative to each other. The print head 24 is capable of marking in any number of colors including the complementary color sets such as cyan, magenta, and yellow. When mapping the area 100 (the mapping process is described later with reference to FIG. 11), sensors 42*a* and/or 42*b* detect the color and characteristic of the surface of area 100. For example, if the apparatus 10 were printing on grass the surface color would be predominantly green. The logic and control unit 35 would indicate to the user via the display 37 what color marking solution is needed. Likewise, the processor is programmed to determine the predominant color of the surface, and indicates to the user whether or not or how much of a background color is to be painted on the area before printing the image.

The coarseness of the surface can be determined by how the distance from the surface to the print head varies in relation to linear distance traveled. In the case where the sensors 42*a* and/or 42*b* sense a dark surface such as asphalt driveway, a supplementary white color may be applied to the area 100 before the cyan, magenta and yellow is applied to create the image 65. Alternately in the case where the sensors 42*a* and/or 42*b* sense a light surface such as concrete a supplementary black color may be added similar to a desktop inkjet printer applying cyan, magenta, yellow and black. When the sensors sense a particular color surface, the printing algorithm in the logic and control unit 35 can automatically adjust the amount of cyan, magenta, yellow, black or white marking solution based on look up tables that have been heuristically determined. Depending on what surface a user desires to mark, any number of colors deemed appropriate for generation of full-color images can be used.

Therefore, referring to FIG. 1, the apparatus 10 is controlled by logic and control unit 35, which receives directions from the input panel 37 (see FIG. 10) and image data from an external memory source such as computer not shown, from the communication device 40 such as an RF receiver and transmitter, from an internal memory source such as the EPROM 55, inserted into the EPROM slot 60 or from the logic and control unit 35 itself. The logic and control unit 35 is in communication with the marking engine 23 and print engine 24 via lines 90*a*, 90*b*, 90*c*, and 90*d*. Using the nozzles 71*a*, 71*b*, 71*c*, and 71*d*, marking engine 15 can create a color image 65 on the large area or walkway 100 as shown in FIG. 9.

Referring to FIG. 9, using encoders 19*a* and 19*b* (see FIGS. 2 and 3) and mapped image 65 (the mapping process is described later with reference to FIG. 11) the apparatus 10 returns to the starting position 102 to begin the printing process. The logic and control unit 35 is electrically coupled by means of suitable power boosting control electronics to the propulsion assembly 15 and steering control 28 for selectively activating the stepper motors 20*a* and 20*b* and steering control 28, thereby rotating the drive wheels 18*a* and 18*b* and propelling the apparatus 10 over the large surface area 100. For example, the propulsion assembly 15 is activated by receiving electrical pulses from the logic and control unit 35. In response to each of the electrical pulses, the stepper motors 20*a* and 20*b* each rotates a fraction of a revolution. In response to rotation of the stepper motors 20*a* and 20*b*, each of the drive wheels 18*a* and 18*b* may rotate independently. The set of drive wheels 18*a* and 18*b* frictionally engages the top surface of the area 100 as each of the wheels rotates, thereby propelling the apparatus 10 over the area 100. The steering wheel 27 operates together with the drive wheels 18*a* and 18*b* to guide the apparatus 10. The encoders 19*a* and 19*b* and sensors 42*a* and 42*b* monitor the position and orientation of the apparatus 10 relative to the area 100 and portion of the image 65, which has already been printed. When printing in the direction indicated in FIG. 4 by arrow 47, sensor 42*a* is active. When printing in the direction indicated by arrow 48, sensor 42*b* is active. Both sensors 42*a* and 42*b* may be active at the same time and may perform different functions such as one sensor sensing the image that has already been printed, while the other senses the distance to the surface.

The logic and control unit 35 counts the number of electrical pulses sent to the stepper motors 20*a* and 20*b* and steering control 28. It should be noted that the present invention is not limited in the use of a stepper motor and steering control since other types of electric motors can be substituted and controlled by electric signals from the logic and control unit 35 with beneficial results. Accordingly, the encoder can be alternatively embodied, for example, by software which programs the logic and control unit 35 to count a number of electrical pulses respectively generated by shaft rotation encoders respectively coupled to each of the rolling members.

Figure 10:
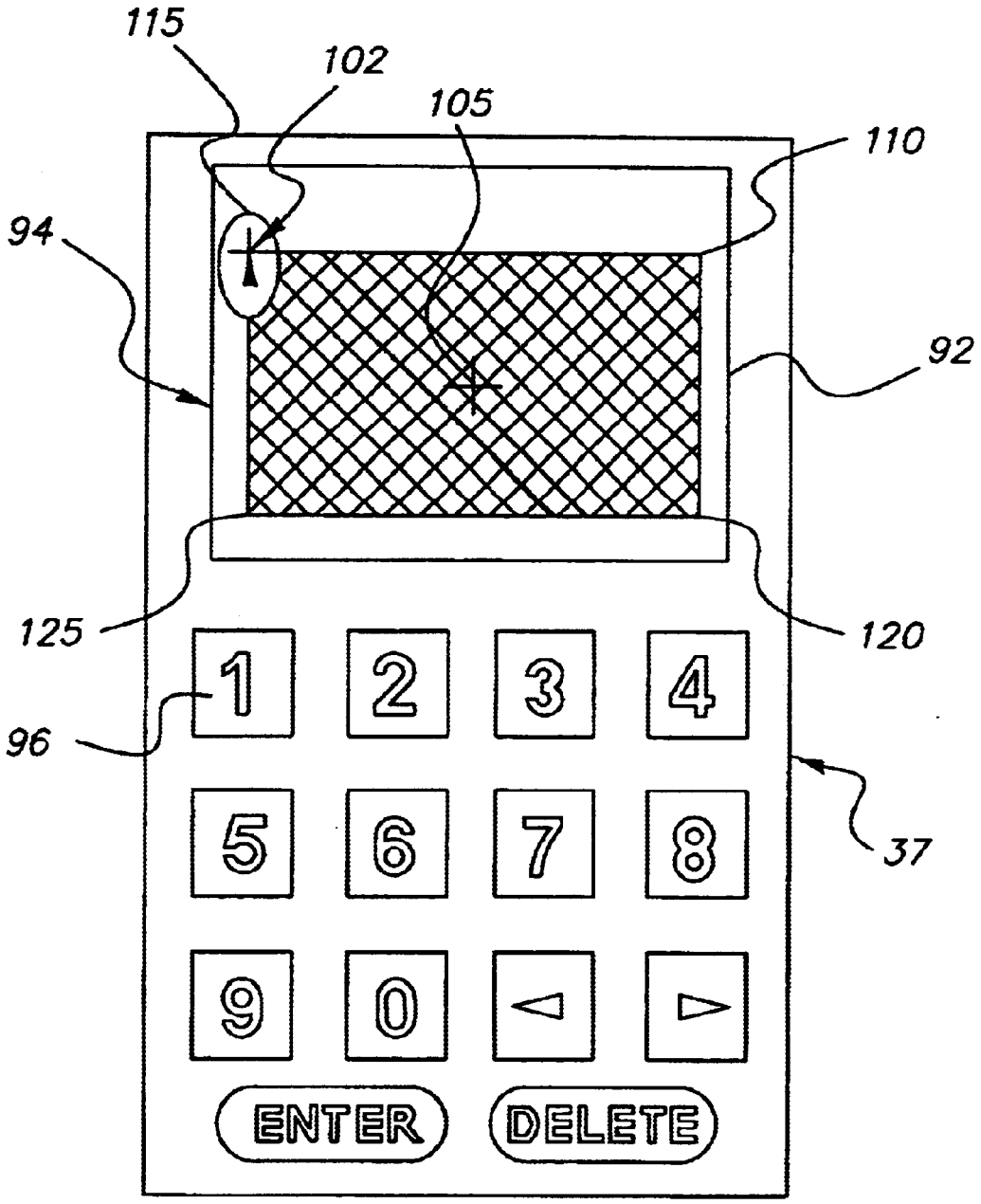
FIG. 10 is a schematic of an input panel of the apparatus illustrated in FIG. 1.

Referring to FIG. 10, the input panel 37 comprises a display 92, which via a fiducial 94 shows the position of the apparatus 10 in relation ship to the large area or walkway 100, and a keyboard 96 for inputting instructions. The display 92 may be a touch screen.

Therefore, referring to FIGS. 1, 9, 10 and 11, the manner in which area 100 is mapped into x, y and z Cartesian coordinates will now be described. First, apparatus 10 is placed upon the large surface area 100 by the user at Step 270. The user then records the orientation of the apparatus 10 on the large area 100 by inputting, via the input panel 37, the location of the starting position 102 of the apparatus 10. For example, the starting position 102 can be located in a center 105, top right 110, top left 115, lower right 120 or lower left 125 position at Step 280. The user selects the image to be printed; the size the image is to be printed and activates the mapping sequence Step 290. Next, the logic and control unit 35 activates sensors 42*a* and 42*b* and encoders 19*a* and 19*b*. That is, the logic and control unit 35 effectively determines distance or proximity of large surface area 100 from sensors 42*a* and 42*b*. Distance of this initial point is determined either by use of light beams 76/78 or follower 155 and encoders 19*a* and 19*b*. This initial point is designated as a datum point "0" and will have Cartesian coordinates of x=0, y=0 and z=distance from sensor 42*a* and 42*b* as at Step 300. The x, y and z coordinates for datum point "0" are sent to logic and control unit 35 and stored therein as at Step 310. Logic and control unit 35 then activates propulsion assembly 15 to increment drive wheels 18*a* and 18*b* and encoders 19*a* and 19*b* a predetermined amount in order to sense a first measurement point "1" on area 100 as at Step 320. This first measurement point "1" is located at an epsilon or very small distance "δ" on area 100 in a predetermined direction from datum point "0" as at Step 330. Moreover, this first measurement point "1" will have coordinates of $x=x_1$, $y=y_1$, and $z=z_1$, where the values of $x_1$, $y_1$ and $z_1$ are distances defining location of measurement point "1" from datum point "0" in the well-known three-dimensional Cartesian coordinate system as illustrated by Step 340. The coordinates of measurement point "1" are sent to logic and control unit 35 and stored therein as at Step 350. Logic and control unit 35 then activates propulsion assembly 15 to increment drive wheels 18*a* and 18*b* and encoders 19*a* and 19*b* epsilon distance "δ" to a second measurement point "2" on area 100 as at Step 360. That is, this second measurement point "2" is located at the epsilon distance "δ" on area 100 in a predetermined direction from first measurement point "1" as illustrated by Step 370. Moreover, this second measurement point "2" will have coordinates of $x=x_2$, $y=y_2$ and $z=z_2$, where the values of $x_2$, $y_2$ and $z_2$ are distances defining separation of measurement point "2" from datum point "0" in the three-dimensional Cartesian coordinate system as illustrated by Step 380. These coordinates of second measurement point "2" are sent to logic and control unit 35 and stored therein as at Step 390. In similar manner, logic and control unit 35 activates propulsion to assembly 15 to increment drive wheels 18*a* and 18*b* and encoders 19*a* and 19*b* by increments equal to epsilon distance "δ" about the entire area 100 to establish values of $x=0, 1, \ldots n_x$; $y=0, 1, \ldots n_y$; and $z=0, 1, 2, \ldots n_z$, where $n_x$, $n_y$ and $n_z$ equal the total number of measurement points to be taken on area 100 in the x, y and z directions, respectively as at Step 400. Each measurement point is spaced-apart from its neighbor by epsilon distance "δ" as illustrated by Step 410. In this manner, all measurement points describing area 100 are defined relative to initial datum point "0", which is defined by x=0, y=0 and z=distance from sensor 42*a* and 42*b* as illustrated by Step 420. The process disclosed hereinabove results in a three-dimensional grid map of area 100 being stored in logic and control unit 35 as x, y and z coordinates as at Steps 430, 440, 445 and 450. Alternately the entire area need not be mapped if the dimensions of the area where the image is to be printed are known.

Referring again to FIGS. 1, 9, 10 and 11, logic and control unit 35 performs a calculation which justifies color image 65 stored therein with the x, y and z map of area 100 as at Step 460. Preferably color image 65 has been previously stored in logic and control unit 35 and represented therein in the form of a plurality of color points defined by x' and y' two-dimensional Cartesian coordinates. That is, each point in color image 65 stored in logic and control unit 35 has been previously assigned x', y' and a color value for each x' and y' value representing color image 65 in the x'-y' two-dimensional plane. This x'-y' plane has an origin defined by values of x'=0 and y'=0. The values in the x'-y' plane range from $x'=0, 1, 2, \ldots n_{x'}$, and from $y=0, 1, 2, \ldots n_{y'}$, where $n_{x'}$ and $n_{y'}$ equal the total number of color pixel points representing color image 65 in the x' and y' directions, respectively. Logic and control unit 35 then mathematically operates on the values defining the x'-y' plane of color image 65 in order to justify the x', y' and color values forming color image 65 to the x and y measurement values forming color map of area 100. That is, logic and control unit 35 multiplies each x' and y' value by a predetermined scaling factor, so that each x' and y' value is respectively transformed into corresponding x" and y" values as at Step 470. There are several methods, which may be used to scale the image. One technique increases the size of each the individual pixels. A preferred method is to increase the number of pixels by interpolation. The transformation can be preformed via texture mapping techniques such as those described in *Advanced Animation and Rendering Techniques Theory and Practice* by Watt and Watt. These techniques are well known in the art. The z coordinates of the measurement values obtained by sensor 42*a* and/or 42*b* remain undisturbed by this justification. That is, after logic and control unit 35 scales the x' and y' values, logic and control unit 35 generates corresponding x" and y" values (with the z coordinate values remaining undisturbed). The x" values range from $x''=0, 1, 2, \ldots n_{x''}$ and the y" values range from $y''=0, 1, 2, \ldots n_{y''}$, where $n_{x''}$ and $n_{y''}$ equal the total of pixel points representing image 65 in the x" and y" directions, respectively as illustrated by Step 480. It should be understood from the description hereinabove, that once the values of x" and y" are defined, the values of z are predetermined because there is a unique value of z corresponding to each x" and y" pair as illustrated by Step 490. These values of x", y" and z define where ink pixels are to be applied on area 100 as illustrated by Step 500. As described herein below, after the map and color image 65 stored in logic and control unit 35 are justified, logic and control unit 35 controls encoders 19*a* and 19*b*, stepper motors 20*a* and 20*b*, print head 24 and positioning mechanism 62 to print the now justified color image 65 on area 100 as described previously in FIG. 7. If desired, the position of the color image 65 in the x-y plane stored in logic and control unit 35 may be matched to the corresponding mapped portion of area 100 stored in the x'-y' plane in order to obtain the necessary justification.

Figure 12:
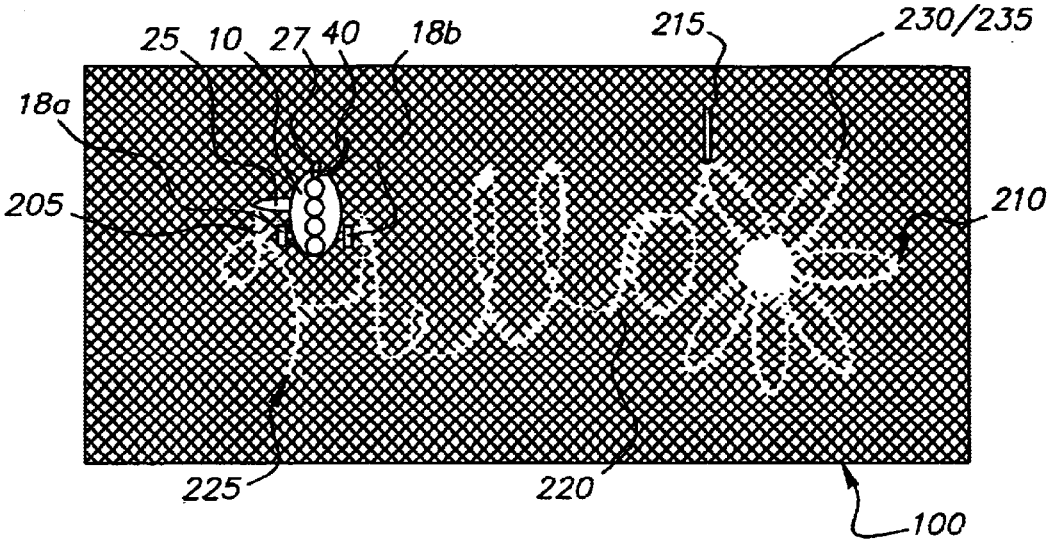
FIG. 12 is a schematic drawing on a large surface area or walkway with an image formed by use of a handheld marker thereon made in accordance with another embodiment of the invention.
Figure 13:
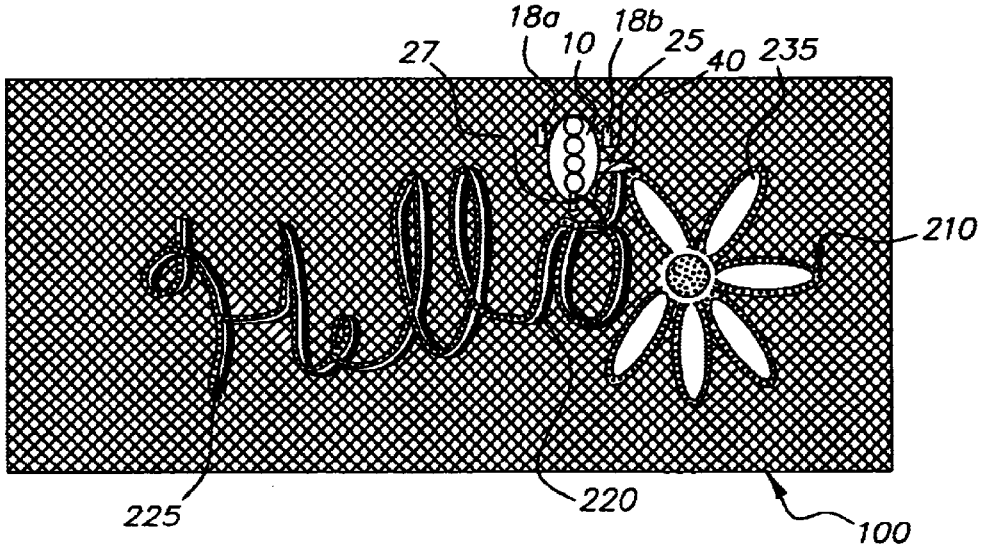
FIG. 13 is the schematic drawing of FIG. 12 completed by the apparatus illustrated in FIG. 1.

In another embodiment referring now to FIGS. 12 and 13, a path 205 representing an image 210 is drawn on the large surface area all walkway 100 using a handheld marker 215, which applies a material 220 such as a fluorescent dye, iron oxide, or a colorant, which is detected by the sensor 42*a* and/or 42*b* shown in FIG. 1. The marker 215 is used to draw the image 210, which can be a word 225, or an outline 230 of a graphic 235, etc. Using the signal produced by the sensor 42*a* and/or 42*b* as it tracks the material 220, the logic and control unit 35 controls the marking engine 23, the propulsion assembly 15, and the steering mechanisms 28 to add a selected color to the word 225 or fills in the graphic 235 completing the image 210 as the apparatus 10 follows the material 220. When filling in the outline 230 of the graphic 235 etc., the apparatus 10 follows the map stored in the internal memory or using the sensor 42*a* and/or 42*b* senses the outline 230 previously created by the marker 215 or printed by the marking engine 23.

Figure 14:
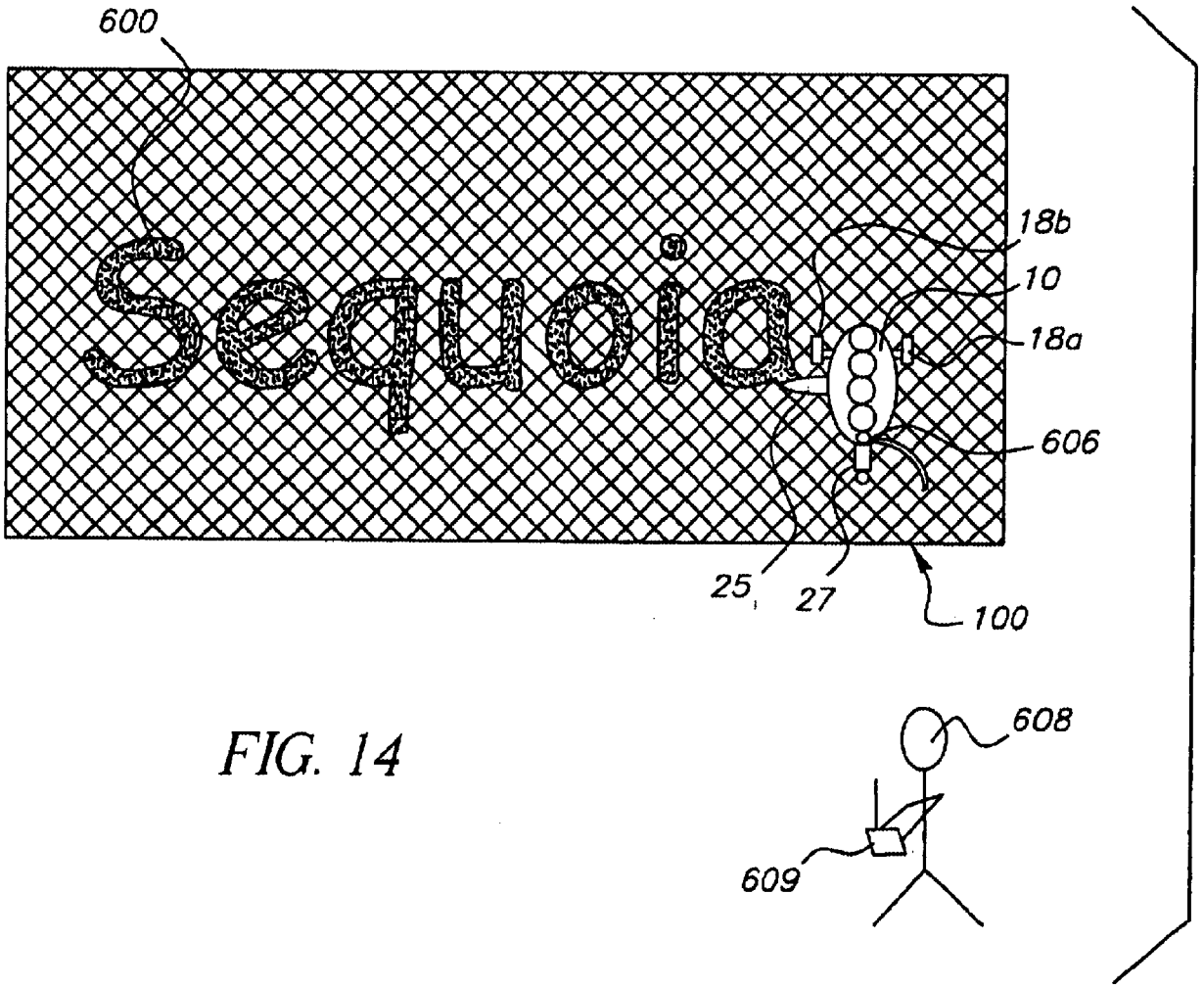
FIG. 14 is a schematic drawing on the large surface area or walkway of FIG. 9 with an image formed in accordance with an aspect of the invention by use of a remote control device.

Referring to FIG. 14 in yet another embodiment of the present invention, the apparatus 10 may be guided over the area 100 using a remote control receiver device 606 such as a radio remote control used to control a remote control toy car or airplane as is known to those skilled in the art. The operator 608 holding a transmitter 609 and operating same to guide the apparatus 10 in this manner the marking engine 24 can be used to write or print an image 600 such as a name on the area 100.

Figure 15:
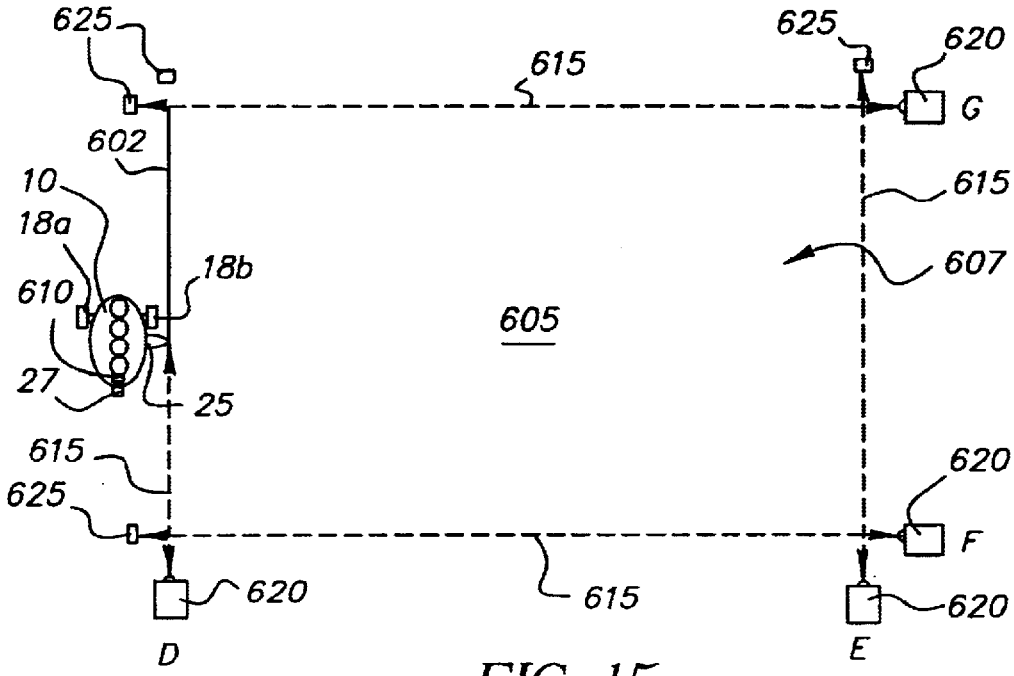
FIG. 15 is a schematic drawing on a large surface area or walkway with an image formed thereon by use of a laser beam and the apparatus of FIG. 1.

Now referring to FIG. 15 in another embodiment of the present invention, apparatus 10 is used to print lines 602 on grass 605, much like people put lines down for badminton and volleyball courts 607. The apparatus 10 can follow signals received by the communications device 40 or may be equipped with a light sensor 610, which is used to sense and follow a laser beam 615 from a laser 620. The laser is placed and aligned at position "D: using a reflector 625 then positions "E", "F", and "G". After the laser 620 is placed, the apparatus 10 using the sensor 610 follows the laser beam 615 and prints the line 602.

Figure 16:
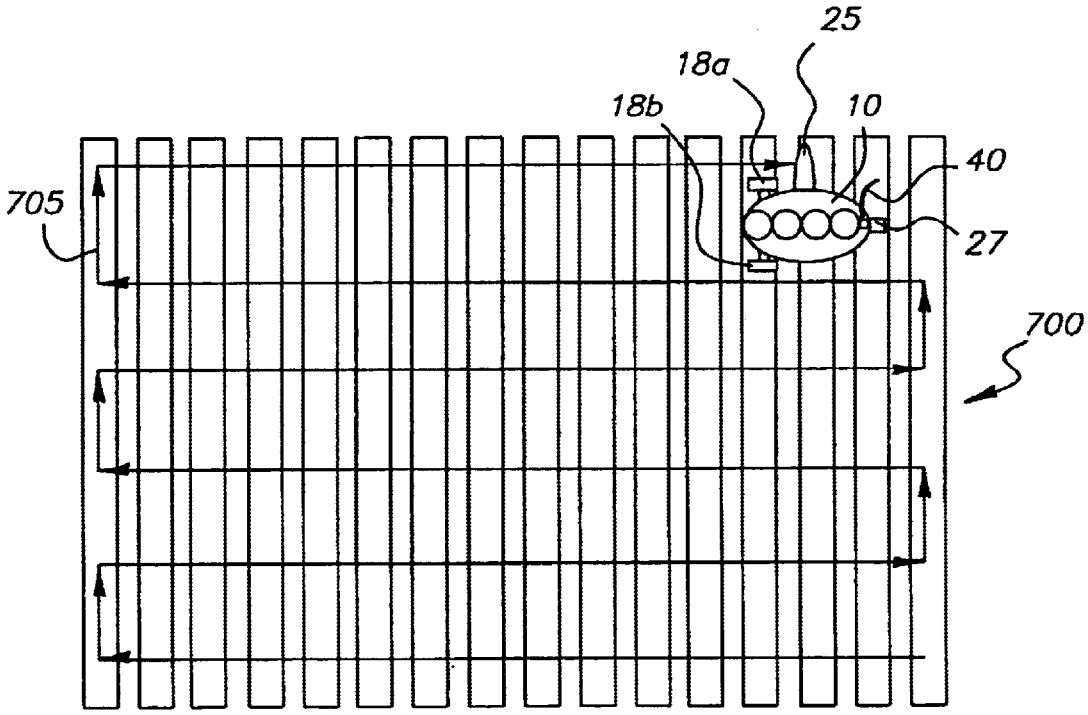
FIGS. 16 and 17 are schematic drawings on a large surface area or walkway such as a deck being painted using the apparatus of FIG. 1.
Figure 17:
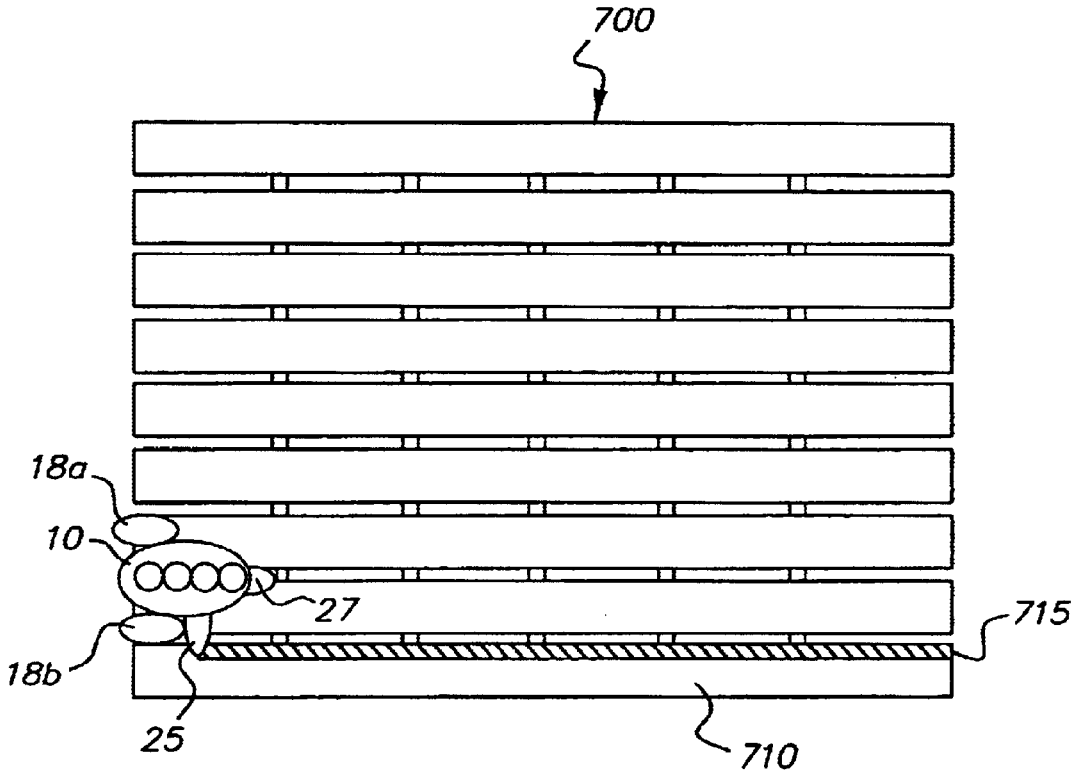

Referring to FIGS. 16 and 17, another aspect of the invention is to apply a stain or paint to decks 700 with apparatus 10 by following the path 705 drawn using the marker 215 described in FIG. 12. In this embodiment the material applied may be invisible to the unaided eye but visible to the sensors 42*a* and/or 42*b* or using a sensor 42*a* and/or 42*b* or a guide finger 43 such as a mechanical sensor (see FIG. 1) to following a board. Following the edge of a board 710 with sensor 42*a* and/or 42*b* or a guide finger 43, the apparatus 10 could add a decorative patterned border 715 to an otherwise plain decking material.

As is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

PARTS LIST

| | |
|---|---|
| 10 | apparatus |
| 15 | propulsion assembly |
| 18a, 18b | drive wheel |
| 19a, 19b | encoder |
| 20a, 20b | stepper motor |
| 22 | frame |
| 23 | marking engine |
| 24 | print head |
| 25 | a sliding or rotating arm |
| 26 | arm positioner |
| 27 | steerable wheel |
| 28 | steering control |
| 29a, 29b | swath or line of print |
| 30 | power supply |
| 31 | arrow |
| 35 | logic and control unit |
| 37 | input panel |
| 40 | communications device |
| 42 | sensor |
| 43 | guide finger |
| 44a, 44b, 44c, 44d | arrows |
| 45a, 45b, 45c, 45d | reservoirs |
| 47 | arrow |
| 48 | arrow |
| 50a, 50b, 50c, 50d | marking solutions |
| 55 | Erasable Programmable Read Only Memory (EPROM) |
| 60 | EPROM slot |
| 62 | positioning mechanism |
| 65 | image |
| 70 | plate |
| 71a, 71b, 71c, 71d | nozzles |
| 72 | common point |
| 73a, 73b, 73c, 73d | tubing lines |
| 74 | photodiode light source |
| 75a, 75b, 75c, 75d | channel-shaped chambers |
| 76 | laser light beam |
| 78 | reflected light beam |
| 79 | light detector |
| 80 | sensor |
| 81a, 81b, 81c, 81d | nozzle orifices |
| 82 | marking solution meniscus |
| 85 | marking solution body |
| 86 | surface area |
| 87a, 87b, 87c, 87d | transducers |
| 88 | drop |
| 89 | arrow |
| 90a, 90b, 90c, 90d | lines |
| 92 | display |
| 94 | fiducial |
| 96 | keyboard |
| 100 | area |
| 102 | starting position |
| 105 | center |
| 110 | top right |
| 115 | top left |
| 120 | lower right |
| 125 | lower left |

-continued

PARTS LIST

| | |
|---|---|
| 150 | telescoping spring-loaded follower |
| 155 | end portion |
| 157 | arrow |
| 205 | path |
| 210 | image |
| 215 | marker |
| 220 | material |
| 225 | word |
| 230 | outline |
| 235 | graphic |
| 270 through 500 | generalized process steps |
| 600 | image |
| 602 | line |
| 605 | grass |
| 606 | remote control receiver |
| 607 | volley ball court |
| 608 | operator |
| 609 | transmitter |
| 610 | light sensor |
| 615 | laser beam |
| 620 | laser |
| 625 | reflector |
| 700 | deck |
| 705 | path |
| 710 | board edge |
| 715 | decorative patterned border |

What is claimed is:

1. An apparatus for printing an image on an area of a walkway, the apparatus comprising:

a marking engine responsive to digital signals representing an image for imagewise marking a surface of the area with a color marking medium to form a visible image on the surface of the area during an image recording mode;

a self-propelled and automatically steered vehicle that supports the marking engine and includes a drive that engages the surface of the area at plural locations for moving the marking engine along the surface, the marking engine being located outboard of an area defined by lines connecting the plural locations; and a logic and control unit for controlling the drive and the marking engine to print the image by printing adjacent swaths in sequential order without the drive rolling over a swath already printed so that during operation of the marking engine for imagewise marking during the image recording mode the drive does not engage areas of the surface that have been previously imagewise marked and the drive providing movement of the marking engine to position the marking engine at substantially all points to be marked in the area.

2. The apparatus of claim 1 and wherein the drive automatically moves the marking engine over the area to sense color on the surface before printing the image.

3. The apparatus of claim 2 and wherein the marking engine is an ink jet marking device and a sensor and control therefore are provided and operative so that the sensor is operative to determine vertical spacing of the marking device from the surface and during the image creation mode vertical spacing of the marking device from the surface is adjusted.

4. The apparatus of claim 3 and wherein vertical adjustments to the marking device are made on a pixel by pixel basis.

5. The apparatus of claim 1 and wherein the marking engine is an ink jet marking device and a sensor and control therefore are provided and operative so that the spacing of the marking device from the surface during printing is adjusted.

6. The apparatus of claim 5 and wherein vertical adjustments to the marking device are made on a pixel by pixel basis.

7. The apparatus of claim 1 and wherein the vehicle includes an internal memory that stores an image to be printed and a processor that is programmed to calculate a scaling factor that justifies the image to a mapping of an area.

8. The apparatus of claim 7 and wherein the marking engine is an ink jet marking device and a sensor and control therefore are provided and operative so that the sensor is operative to determine spacing of the marking device from the surface and the mapping of the image data to the area includes vertical adjustment or vertical position information regarding vertical spacing of the marking device to the surface.

9. The apparatus of claim 7 and wherein the mapping of the image data to the area controls movement of the vehicle over the area.

10. The apparatus of claim 1 and including a remote control device that provides signals for controlling movement of the vehicle.

11. The apparatus of claim 1 and wherein a sensor on the vehicle senses color of the surface and the logic and control unit is programmed to adjust color selection for forming the image in accordance with sensed surface color.

12. The apparatus of claim 1 and wherein a sensor on the vehicle senses color of the surface and the logic logic and control unit is programmed to determine whether or not or how much of a background color is to be painted on the surface before printing the image.

13. The apparatus of claim 1 and wherein a sensor on the vehicle senses color of the surface and the logic and control unit determines which pixel locations are not to be printed where there is a substantial match between sensed surface color and color information in a color data of the image to be printed.

14. The apparatus of claim 1 and wherein a sensor on the vehicle senses a human drawn outline of a graphic image on the walkway and generates signals relative to such outline and the logic and control unit in response to the signals provides controlled movement of the vehicle to position the marking engine to deposit marking medium within the outline of the graphic image.

15. A method for printing an image on a walkway, the method comprising:

imagewise marking a surface of the walkway with a color marking solution to form a visible image on an area of the surface of the walkway during an image recording mode of a marking engine that is responsive to digital image signals representing the visible image to be printed;

automatically steering a vehicle that supports the marking engine and which includes a drive that engages the surface at plural locations and moving the marking engine relative to the surface, the marking engine being located outboard of an area defined by lines connecting the plural locations so that during operation of the marking engine for imagewise marking during the image recording mode wherein swaths of the image are printed with adjacent swaths being printed in sequential order and the movement of the vehicle being such that the drive does not engage areas of the surface that have been previously imagewise marked and the drive providing movement of the marking engine to position the marking engine to print at substantially all points to be marked in the area.

16. The method of claim 15 and automatically moving a sensor over the surface to sense the color on the surface before printing the image.

17. The method of claim 16 and wherein the marking engine is an ink jet marking device and a sensor and control therefore are provided and operative to determine vertical spacing of the marking device from the surface and during the image recording mode vertical spacing of the marking device from the surface is adjusted.

18. The method of claim 17 and wherein vertical adjustments to the marking device are made on a pixel by pixel basis.

19. The method of claim 15 and wherein the marking engine is an ink jet marking device and during a non-image recording mode a determination is made spacing of the marking device from the surface and during the image recording mode spacing of the marking device from the surface is adjusted.

20. The method of claim 19 and therein vertical adjustments to the marking device are made on a pixel by pixel basis.

21. The method of claim 15 and wherein the vehicle includes an internal memory that stores an image to be printed and a processor that is programmed to calculate a scaling factor that justifies the image to a mapping of an area.

22. The method of claim 21 and wherein the marking engine is an ink jet marking device and a determination is automatically made of spacing of the marking device from the surface and the mapping of the image data to the area includes vertical adjustment or vertical position information regarding vertical spacing of the marking device to the surface.

23. The method of claim 22 and wherein the mapping of the image data to the area controls movement of the vehicle over the area.

24. The method of claim 15 and wherein a remote control device provides signals that control movement of the vehicle.

25. The method of claim 15 and wherein a sensor on the vehicle senses surface color of the surface and a processor is programmed to adjust color selection for forming the image in accordance with sensed surface color.

26. The method of claim 15 and wherein a sensor on the vehicle senses color information of the surface and a processor determines whether or not or how much of a background color is to be painted on the surface before printing the image.

27. The method of claim 15 and wherein a sensor on the vehicle senses color of the surface and a controller determines which pixel locations are not to be printed where there is a substantial match between sensed surface color and color information in a color data of the image to be printed.

28. The method of claim 15 and wherein a sensor on the vehicle senses a human drawn outline of a graphic image on the area and generates signals relative to such outline of the graphic image and a controller in response to the signals controls the marking engine to deposit color marking medium within the outline of the graphic image.

29. A method for printing an image on an area of a walkway, the method comprising:

imagewise marking the area of the walkway with a color marking medium to form a visible image on a surface of the area during an image recording mode of a marking engine that is responsive to digital image signals representing the visible image to be printed;

automatically steering a vehicle that supports the marking engine and which includes a drive that engages a surface of the medium at plural locations and moving the marking engine relative to the surface, the marking engine being located outboard of an area defined by lines connecting the plural locations so that during operation of the marking engine for imagewise marking during the image recording mode the drive does not engage areas of the surface that have been previously imagewise marked and the drive providing movement of the marking engine to position the marking engine for marking at all points to be marked in the area and wherein a sensor on the vehicle senses the color of the surface and a controller determines which pixel locations are not to be printed where there is a substantial match between sensed surface color and color information in a color data of the image to be printed.

30. A method for printing an image on an area of a walkway, the method comprising:

imagewise marking a surface of the area with a color marking medium to form a visible image on the surface during an image recording mode of a marking engine that is responsive to digital image signals representing the visible image to be printed;

automatically steering a vehicle that supports the marking engine and which includes a drive that engages a surface of the walkway at plural locations and moving the marking engine relative to the surface, the marking engine being located outboard of an area defined by lines connecting the plural locations so that during operation of the marking engine for imagewise marking during the image recording mode the drive does not engage areas of the surface that have been previously imagewise marked and the drive providing movement of the marking engine to position the marking engine at substantially all points to be marked in the area, and wherein a sensor on the vehicle senses an outline of a graphic image drawn by a human on the area and generates signals relative to such outline and in response to the signals there is provided controlled movement of the vehicle so as to cause the marking engine to deposit marking medium within the outline of the graphic image.

* * * * *